US005184735A

United States Patent [19]

Black

[11] Patent Number: 5,184,735

[45] Date of Patent: Feb. 9, 1993

[54] GOLF BALL DISPLAY RACK

[75] Inventor: Danny O. Black, San Francisco, Calif.

[73] Assignee: Advanced Medical Nutrition, Inc., Hayward, Calif.

[21] Appl. No.: 765,603

[22] Filed: Sep. 25, 1991

[51] Int. Cl.[5] ..... A47F 7/00

[52] U.S. Cl. ..... 211/14; 224/919; 312/49

[58] Field of Search ..... 211/14, 70.2, 59.2; 224/919, 247; 206/315.9, 315.91; 312/49, 245; D6/552

[56] References Cited

U.S. PATENT DOCUMENTS

| | | | |
|---|---|---|---|
| D. 184,774 | 3/1959 | Smith | D6/552 |
| D. 320,325 | 10/1991 | Barfield | D6/552 |
| 1,054,707 | 3/1913 | Mertens | 211/59.2 |
| 1,983,499 | 12/1934 | Rosenthal | 206/315.9 |
| 2,221,704 | 11/1940 | Farley | 312/49 |
| 2,767,854 | 10/1956 | Barrett | 312/49 X |
| 3,497,676 | 2/1970 | Gravatt | 224/919 X |
| 4,396,237 | 8/1983 | Henry | 211/59.2 X |
| 4,678,108 | 7/1987 | Inman | 224/919 X |
| 4,840,332 | 6/1989 | Hoyt | 224/919 X |
| 4,955,529 | 9/1990 | Barnhart | 206/315.9 X |

FOREIGN PATENT DOCUMENTS 396989 8/1933 United Kingdom ..... 312/49

OTHER PUBLICATIONS

"Golf Day" Catalog, Deluxe Golf Ball Display Rack, in existence as of Sep. 5, 1991, p. 26.

"Austad's 1991 Spring Golf Catalog", Wall of Fame golf ball display rack.

*Primary Examiner*—Carl D. Friedman
*Assistant Examiner*—Ko-Hung Chan
*Attorney, Agent, or Firm*—Townsend and Townsend

[57] ABSTRACT

A golf ball display rack (2) includes a generally vertically oriented body (4), a base (6) at the bottom (8) of the body and a plurality of vertical dividers (14) mounted to the body to define a plurality of vertical ball slots (16). Each of the ball slots is sized to support a number of golf balls (20) in a vertical column, one golf ball on top of the other. The outer sides (18) of the ball slots are open to permit the golf balls within the slots to be viewed. The ball slots are arranged in outwardly bowed configuration so as to provide enhanced viewing. Enhanced viewing is also aided by the use of transparent dividers. The display rack can be supported by a horizontal support surface or it can be hung on a wall.

9 Claims, 2 Drawing Sheets

GOLF BALL DISPLAY RACK

BACKGROUND OF THE INVENTION

Golfing, like other sports and activities, can create many fond memories and mementos. Many golfers collect special golf balls, such as those with special logos, special tournament balls, balls used by famous golfers or balls used to make a special shot, such as a hole in one. In response to this desire to display special golf balls, various types of display racks have been created. One type is a wooden rack having a number of rectangular openings. The base of each opening typically has a depression within which the ball sits. However, these types of golf ball display racks are not a terribly efficient use of space. Another type of golf ball display rack eliminates the vertically oriented dividers between the golf balls; however, there are still horizontally oriented dividers upon which the golf balls rest. With both types of display racks, the golf balls are easily removable so that a simple jar of the ball rack would allow the golf balls to inadvertently fall from the ball rack. Also, unauthorized removal, such as by young children, can also create damaged or lost golf balls, which are sometimes irreplaceable.

SUMMARY OF THE INVENTION

The present invention is directed to a golf ball display rack which allows the golfer to display special balls, such as those with special logos, tournament balls, or balls used by famous golfers, in an attractive, secure and efficient manner.

The golf ball display rack includes a generally vertically oriented body, a base at the bottom of the body and a number of dividers mounted to the body. The dividers define a number of vertical ball slots. Each of the ball slots is sized to support a number of golf balls, the bottommost golf ball supported by the base, in a vertical column, one golf ball on top of the other. The outwardly facing sides of the ball slots are open to permit the golf balls within the slots to be viewed. The ball slots are arranged in outwardly bowed configuration so as to provide enhanced viewing. Viewing is also aided by the use of transparent dividers. The rack can be supported by a horizontal support surface or the rack can be hung on a wall or other vertically oriented support.

One of the primary advantages of the invention is that it not only provides virtually unobstructed viewing of the golf balls displayed, it does so while maximizing the number of golf balls displayed in a particular area. This is because no horizontally oriented separators are used between the balls to provide the maximum number of balls to be displayed over a particular vertical distance. Similarly, the dividers can be configured to permit extremely close spacing between the columns of golf balls. Thus, for particular size display rack, a maximum number of golf balls can be displayed. This minimization of the space required to display one's golf balls also helps to reduce the cost-per-displayed-golf ball of the display rack.

Another advantage of the invention is that the golf balls are securely contained within the display rack. The golf balls must be lifted up and out of the ball slots for removal, preferably only after the top has been removed from the body. This not only helps keep the golf balls secured, it can also keep young children from removing, playing with and perhaps damaging or losing one of the potentially irreplaceable golf balls.

Other features and advantages of the invention will appear from the following description in which the preferred embodiment has been set forth in detail in conjunction with the accompanied drawings.

DESCRIPTION OF THE PREFERRED EMBODIMENT

Figure 1:
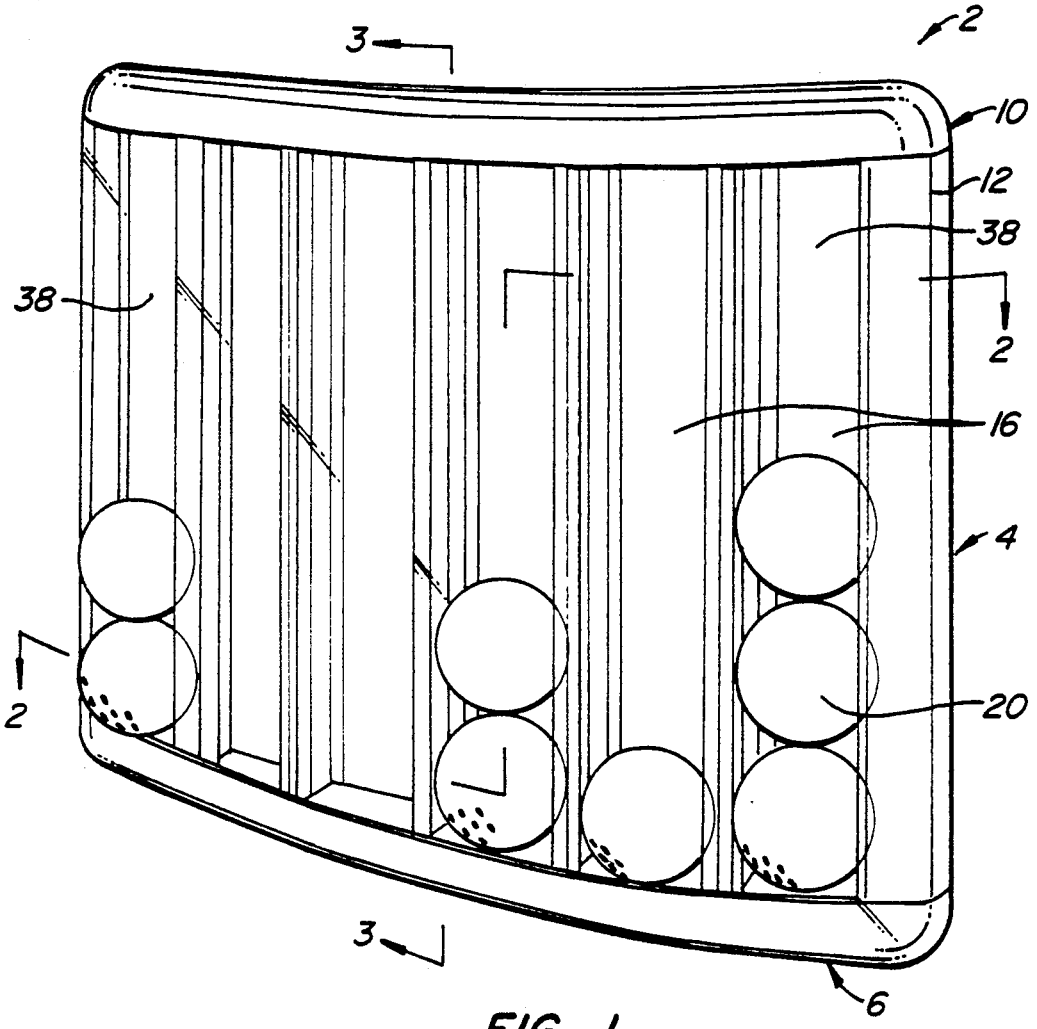
FIG. 1 is an overall view of a golf ball display rack made according to the invention.
Figure 2:
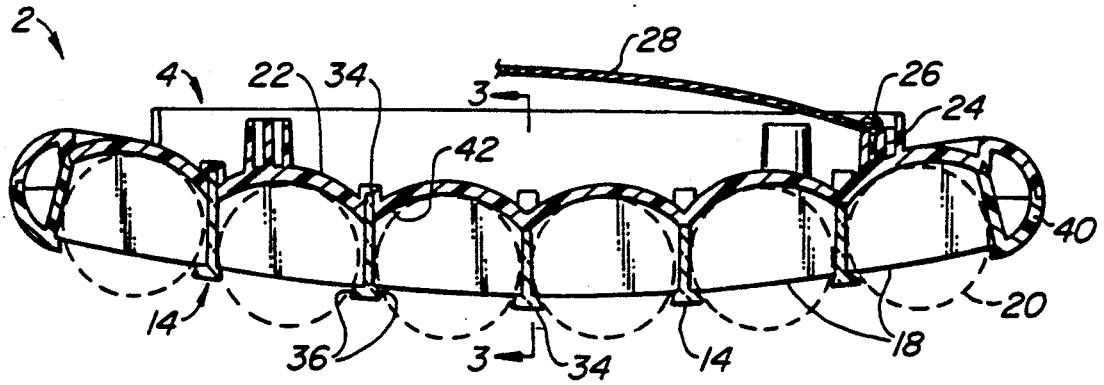
FIG. 2 is a cross sectional view of the display rack taken along line 2—2 of FIG. 1.
Figure 3:
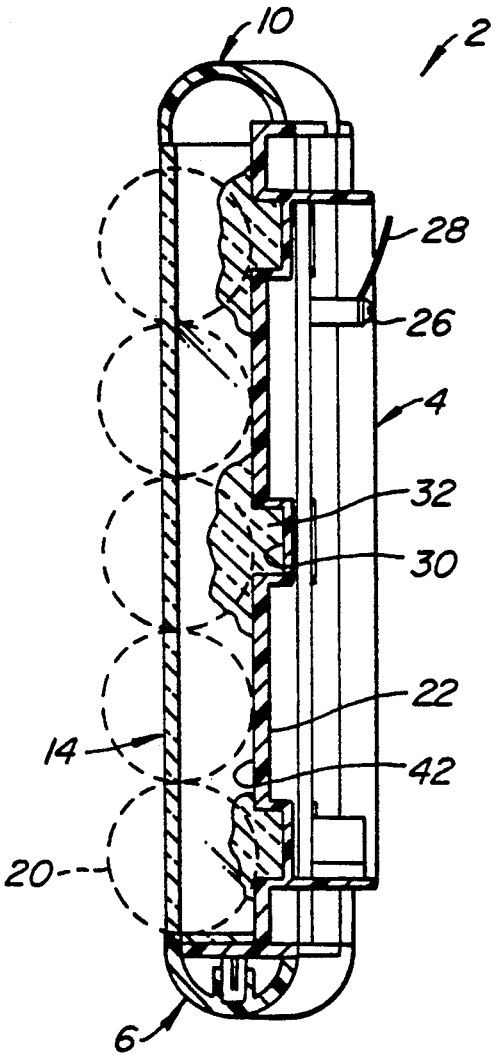
FIG. 3 is a cross-sectional view of the display rack taken along line 3—3 of FIG. 1.

FIGS. 1 and 2 illustrate a golf ball display rack 2 including a generally vertically oriented body 4 having a base 6 mounted to the bottom 8 of body 4. A top 10 is mounted to the upper end of 12 of body 4, typically by a friction fit. Five dividers 14 extend between base 6 and top 10 to define a number of vertical slots 16 having an open outer side 18 within which columns of golf balls 20 are supported.

Body 4 includes a generally scalloped-shaped back member 22 from which a pair of mounting lugs 24 extend. Mounting lugs 24 are used to fasten, such as using screws 26, the ends of a wire 28 to body 4 to permit golf ball rack 2 to be hung on a wall or other vertical surface, not shown. Scalloped back member 22 also includes a number of openings 30 which accept mating extensions 32 of dividers 14. The outer ends 34 of dividers 14 have inwardly and rearwardly facing angled surfaces 36 which engage balls 20 and hold the balls within slots 16. The outermost slots 38 are also partially defined by end pieces 40. Thus, slots 14 are defined by the inner wall 42 of back member 22, dividers 14 and, for the outermost slots 38, end pieces 40.

As can be seen in FIGS. 1 and 2, slots 16 are oriented in an outwardly bowed or convex configuration. This provides additional viewing and enhances the visibility, especially from the side, of golf balls 20. Also, dividers 14 are preferably made of clear plastic material, such as acrylic, for additional unobscured views of the balls. Body 4 and end pieces 40 are preferably made from plastic, such as high impact styrene. As is evident from FIGS. 1 and 2, since golf balls 20 rest one on top of the other, a maximum vertical packing efficiency is achieved. Also, since dividers 14 do not act to support the golf balls, they can be relatively thin. This permits the lateral packing efficiency to be maximized as well. Therefore, the total number of golf balls which can be displayed by golf ball rack 2 for a given surface area is maximized.

To use golf ball rack 2, the user lifts top 10 from upper ended 12 of body 4. The user then places or removes golf balls 20 from one or more slots 16 as desired and then replaces top 10 on upper end 12 of body 4. Golf ball rack 2 can then be hung from a wall or other vertical surface using wire 28.

Modification and variation can be made to the disclosed embodiment without departing from the subject of the invention as defined in the following claims. For example, the entire golf ball rack 2 could be made of a clear plastic material instead of just dividers 14. Dividers 14 need not be solid members but could be simply round rods extending between top 10 and base 6 at appropriate locations; this would enable the lateral spacing of balls 20 to be even closer together if that were desired. Top 10 could be made with cut-outs to permit balls 20 to be removed from rack 2 without the need to remove top 10 from body 4. A base stabilizer could be used to provide greater stability for base 6 when rack 2 is to be supported on a horizontal surface. Inner wall 42 and dividers 14 could be semi-cylindrical in shape with their surfaces having about the same radius of curvature of golf balls 20.

What is claimed is:

1. A display rack, for use with golf balls, comprising:

a generally vertically oriented body having a generally flat back and a bottom;

a base at the bottom of the body;

a plurality of generally vertically oriented dividers mounted to the body to define a plurality of generally vertically oriented golf ball slots, the plurality of golf ball slots being arranged in an outwardly bowed configuration relative to the generally flat back providing enhanced viewing of the golf balls, each of said golf ball slots sized to support a plurality of the golf balls on said base in a vertical column one on top of the other;

said golf ball slots each having an open outer side being generally smaller than the golf balls so the golf balls cannot pass through the open outer side, the open outer side permitting viewing of the golf balls situated within the golf ball slots; and a top secured to the body and overlying the golf ball slots.

2. The display rack of claim 1 wherein the dividers are transparent to further enhance the view of the balls.

3. The display rack of claim 1 further comprising means for securing the body to a vertically oriented support.

4. The display rack of claim 1 further comprising means for securing the golf balls within the ball slots.

5. A display rack for golf balls comprising:

a generally vertically oriented body having a bottom;

a base at the bottom of the body;

a plurality of generally vertically oriented dividers mounted to the body to define a plurality or generally vertically oriented ball slots, each of said ball slots sized to support a plurality of the golf balls on said base in a vertical column one on top of the other;

a top removably secured to the body and overlying the ball slots;

said ball slots each having an open outer side so to permit viewing of the golf balls situated within the ball slots;

said top including means for introducing golf balls into and removing golf balls from the ball slots; and means for arranging the open sides of the ball slots in an outwardly bowed configuration to provide enhanced view of the golf balls, the dividers being transparent to further enhance the view of the balls.

6. A display rack, for use with golf balls, comprising:

a generally vertically oriented body having a generally flat back and a bottom;

a base at the bottom of the body; and a plurality of generally vertically oriented dividers mounted to the body to define a plurality of generally vertically oriented golf ball slots, the plurality of golf ball slots being arranged in an outwardly bowed configuration relative to the generally flat back providing enhanced viewing of the golf balls, each of said golf ball slots sized to support a plurality of the golf balls on said base in a vertical column one on top of the other;

said golf ball slots each having an open outer side being generally smaller than the golf balls so the golf balls cannot pass through the open outer side, the open outer side permitting viewing of the golf balls situated within the golf balls slots, the dividers being transparent to further enhance the view of the golf balls.

7. The display rack of claim 6 further comprising a top secured to the body and overlying the golf ball slots.

8. The display rack of claim 6 further comprising means for securing the body to a vertically oriented support.

9. The display rack of claim 6 further comprising means for securing the golf balls within the golf ball slots.

* * * * *